US006663463B1

(12) United States Patent
Dougherty et al.

(10) Patent No.: US 6,663,463 B1
(45) Date of Patent: Dec. 16, 2003

(54) SOUND ACTIVATED TOY VEHICLE

(75) Inventors: William Francis Michael Dougherty, Oakford, PA (US); Mary Ellen Gertrude Fosbenner, Riverton, NJ (US); Robert Jude Henry, Riverside, NJ (US); Matthew Felix Agostini, Philadelphia, PA (US); Gregory John Sisolak, Mt. Laurel, NJ (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/164,807

(22) Filed: Jun. 7, 2002

(51) Int. Cl.[7] ..... A63H 17/34; A63H 5/00

(52) U.S. Cl. ..... 446/409; 446/175; 446/435; 446/436; 446/454

(58) Field of Search ..... 446/175, 270, 446/275, 397, 409, 410, 431, 432, 434, 436, 438, 437, 448, 454, 456, 457, 460, 465, 484

(56) References Cited

U.S. PATENT DOCUMENTS

| | | | | |
|---|---|---|---|---|
| 2,995,866 A | | 8/1961 | Johnson | |
| 3,142,132 A | | 7/1964 | Johnson | |
| 3,444,646 A | | 5/1969 | Domashovetz | |
| 3,961,441 A | | 6/1976 | Sato | |
| 4,085,542 A | | 4/1978 | Mitamura | |
| 4,086,724 A | | 5/1978 | McCaslin | |
| 4,165,581 A | | 8/1979 | Wolf | |
| 4,219,962 A | * | 9/1980 | Dankman et al. | 446/409 |
| 4,411,098 A | | 10/1983 | Birdsall et al. | |
| 4,443,966 A | | 4/1984 | Birdsall | |
| 5,024,626 A | * | 6/1991 | Robbin et al. | |
| 5,032,099 A | | 7/1991 | Chan | |
| 5,195,920 A | * | 3/1993 | Collier | 446/409 |
| 5,334,075 A | | 8/1994 | Kakizaki | |
| 5,407,376 A | * | 4/1995 | Avital et al. | |
| 6,083,104 A | | 7/2000 | Choi | |

FOREIGN PATENT DOCUMENTS

GB 2249735 A * 5/1992 ..... A63H/17/00

* cited by examiner

*Primary Examiner*—Derris H. Banks
*Assistant Examiner*—Bena B. Miller
(74) *Attorney, Agent, or Firm*—Akin, Gump, Strauss, Hauer & Feld, L.L.P.

(57) ABSTRACT

A sound activated toy vehicle includes a body, a chassis, and a motor. The chassis accommodates the body and has at least a front wheel and a rear wheel. The motor is drivingly connected to at least one of the front wheel and the rear wheel. The toy vehicle also includes a sound transducer configured to generate an electrical signal in response to detected sound. The toy vehicle also includes a controller having an input electrically connected to the sound transducer and an output electrically connected to the motor. The controller changes the output to the motor when the electrical signal is received by the input from the sound transducer. The toy vehicle also includes a vehicle accessory having an exterior portion. The vehicle accessory is mounted for movement between a first position and a second position by mechanical power from the motor.

11 Claims, 8 Drawing Sheets

SOUND ACTIVATED TOY VEHICLE

BACKGROUND OF THE INVENTION

The present invention relates generally to sound activated toy vehicles and, more particularly, to a sound activated toy vehicle including a vehicle accessory on either the chassis or the body of the toy vehicle- wherein the vehicle accessory is moved by mechanical power from the motor.

Sound or sonic activated or actuated toy vehicles are fairly well known in the art. Some previously disclosed sound activated vehicles have a sound detector, such as a microphone or crystal, and an electrically operated motor coupled to at least one axle or driveshaft for turning drive wheels. The motor operates in one direction continuously moving the vehicle in that direction, such as generally forward. Another device mounted within the vehicle such as a second motor or a solenoid, is activated or actuated by sound detected by the sound pickup device. The activation of the motor or actuation of the solenoid causes one set of wheels to change steering directions for a predetermined period of time or until another sound is detected. The vehicle continues moving generally forward but is steered slightly left, straight or right by the detection of sound emitted from a remote device, such as a clicker.

In another, more complex version of the previously known sound activated vehicles, the vehicle further includes a second sound detector or a sound detector capable of detecting a second sound. Upon detection of the second sound, the vehicle drive motor reverses direction, separately from the steering control.

What is not provided by the previously disclosed sound activated vehicles is a vehicle that moves or actuates a vehicle accessory in addition to driving the motor in forward or reverse based upon the detection of a remotely generated sound. Further, what is not provided by the previously disclosed sound activated vehicles is a vehicle that will perform different functions based upon a sequence of remotely generated sounds and when they occur during a preprogrammed or timed operation.

BRIEF SUMMARY OF THE INVENTION

Briefly stated, the present invention comprises a sound activated toy vehicle. The toy vehicle includes a body, a chassis, and a motor. The chassis accommodates the body and has at least a front wheel and a rear wheel. The motor is drivingly connected to at least one of the front wheel and the rear wheel. The toy vehicle also includes a sound transducer supported in one of the chassis and body and configured to generate an electrical signal in response to detected sound. The toy vehicle also includes a controller having an input electrically connected to the sound transducer and an output electrically connected to the motor. The controller changes the output to the motor when the electrical signal is received by the input from the sound transducer. The toy vehicle also includes a vehicle accessory having an exterior portion and being supported on at least one of the chassis and the body for movement between a first position and a second position by mechanical power from the motor.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
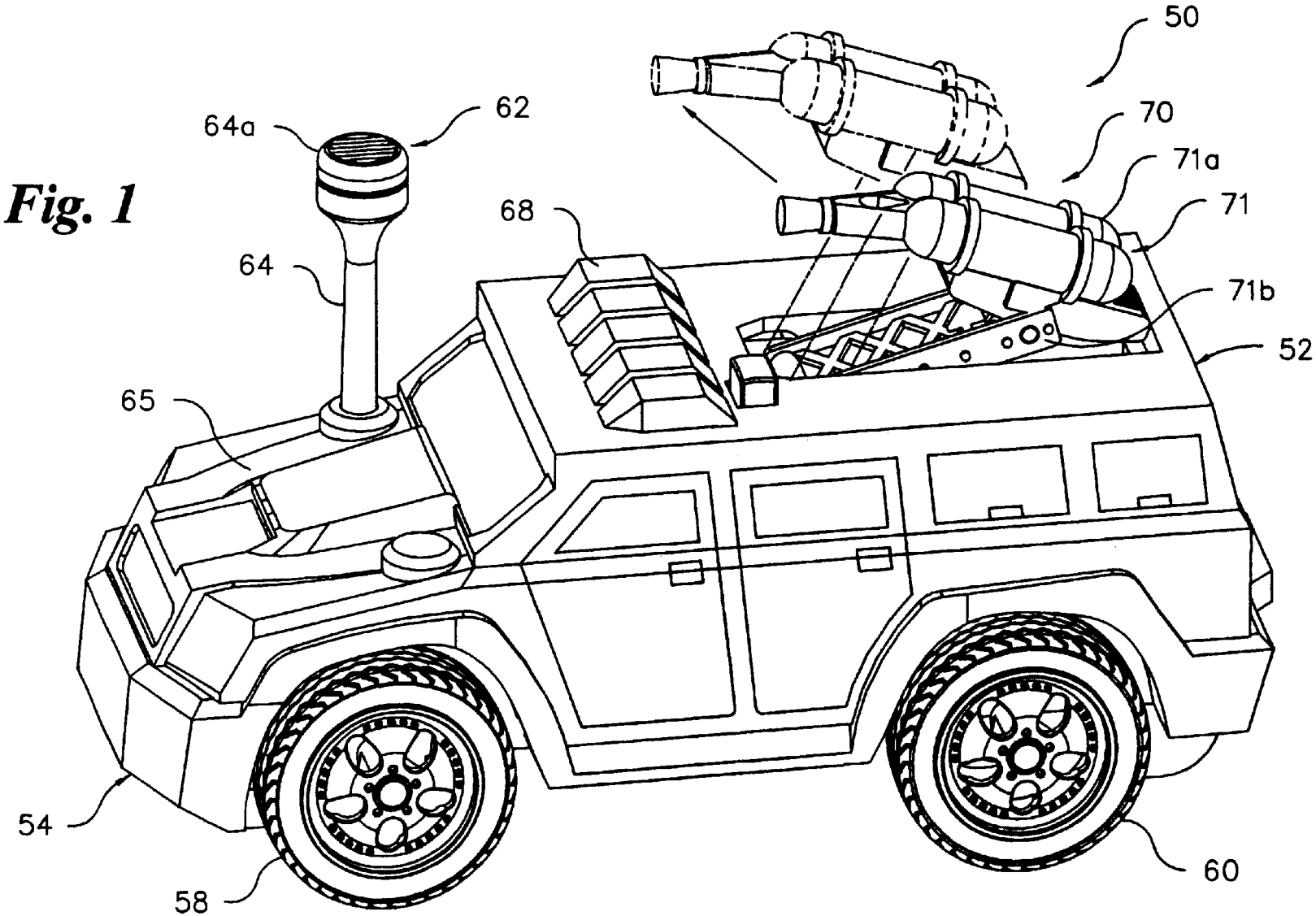
FIG. 1 is a perspective view of a sound activated toy vehicle in accordance with a first preferred embodiment of the present invention.

Certain terminology is used in the following description for convenience only and is not limiting. The words "right," "left," "lower" and "upper" designate directions in the drawings to which reference is made. The words "inwardly" and "outwardly" refer to directions toward and away from respectively, the geometric center of the device discussed and designated parts thereof. The terminology includes the words above specifically mentioned, derivatives thereof and words of similar import. Additionally, the word "a" as used in the claims and in the corresponding portions of the specification, means "one or more than one."

Figure 2:
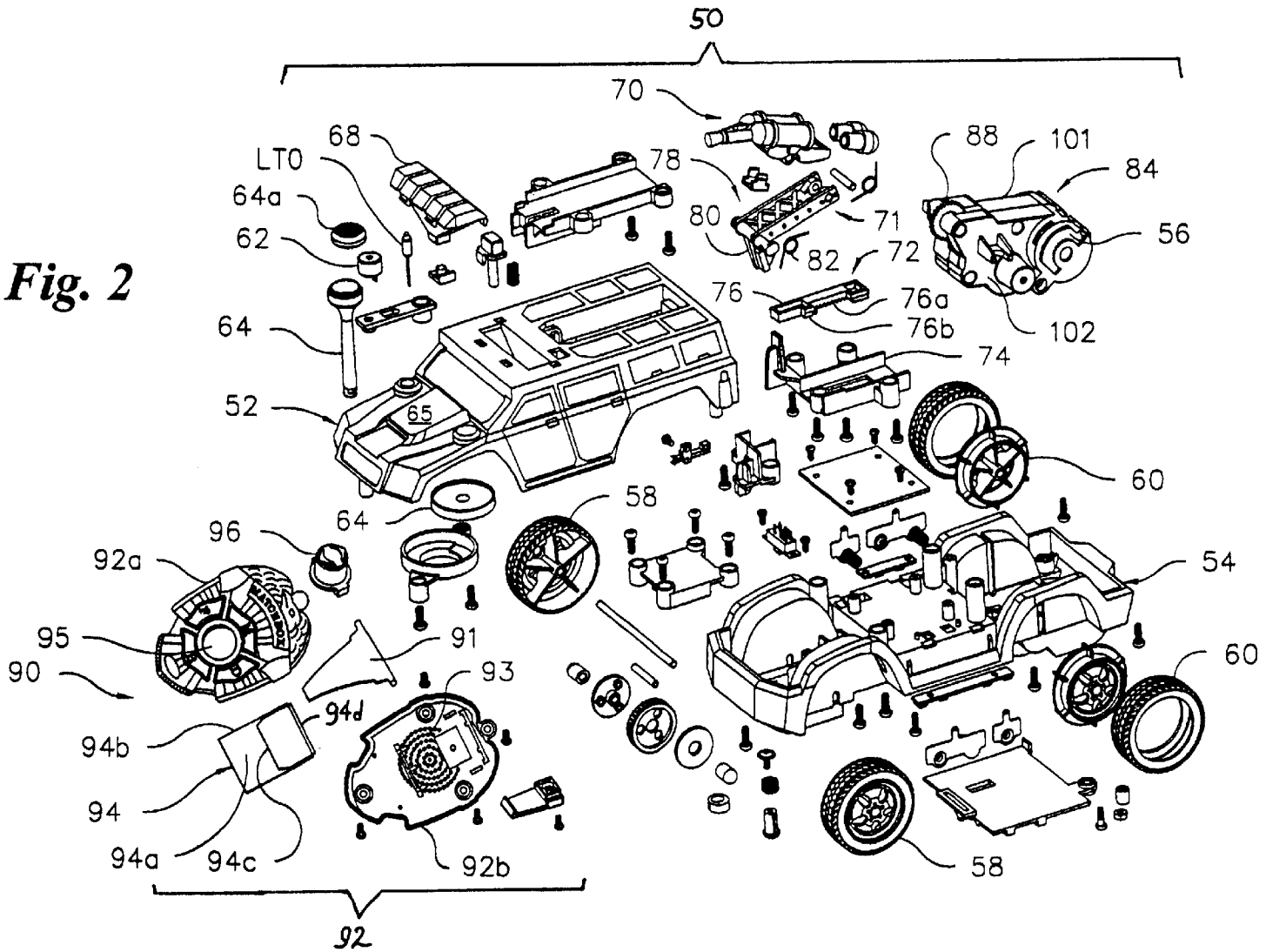
FIG. 2 is an exploded view of the vehicle of FIG. 1 in combination with a remote sound generating device.

In the drawings, like numerals are used to indicate like elements throughout. Referring to the drawings in detail, there is shown in FIGS. 1–2 a sound activated toy vehicle 50 in accordance with a first preferred embodiment of the present invention. Preferably, the sound activated toy vehicle has the overall appearance of either a police car, a fire rig, a fire truck, an ambulance, a rescue vehicle, an emergency vehicle, a tow truck, a sport utility vehicle, an off-road vehicle or a search light vehicle. But, the sound activated toy vehicle 50 may have other overall appearances without departing from the present invention. As shown in FIGS. 1–2, one presently preferred embodiment has the overall appearance of a fire truck with a moveable and foldable hose-boom accessory.

Figure 7:
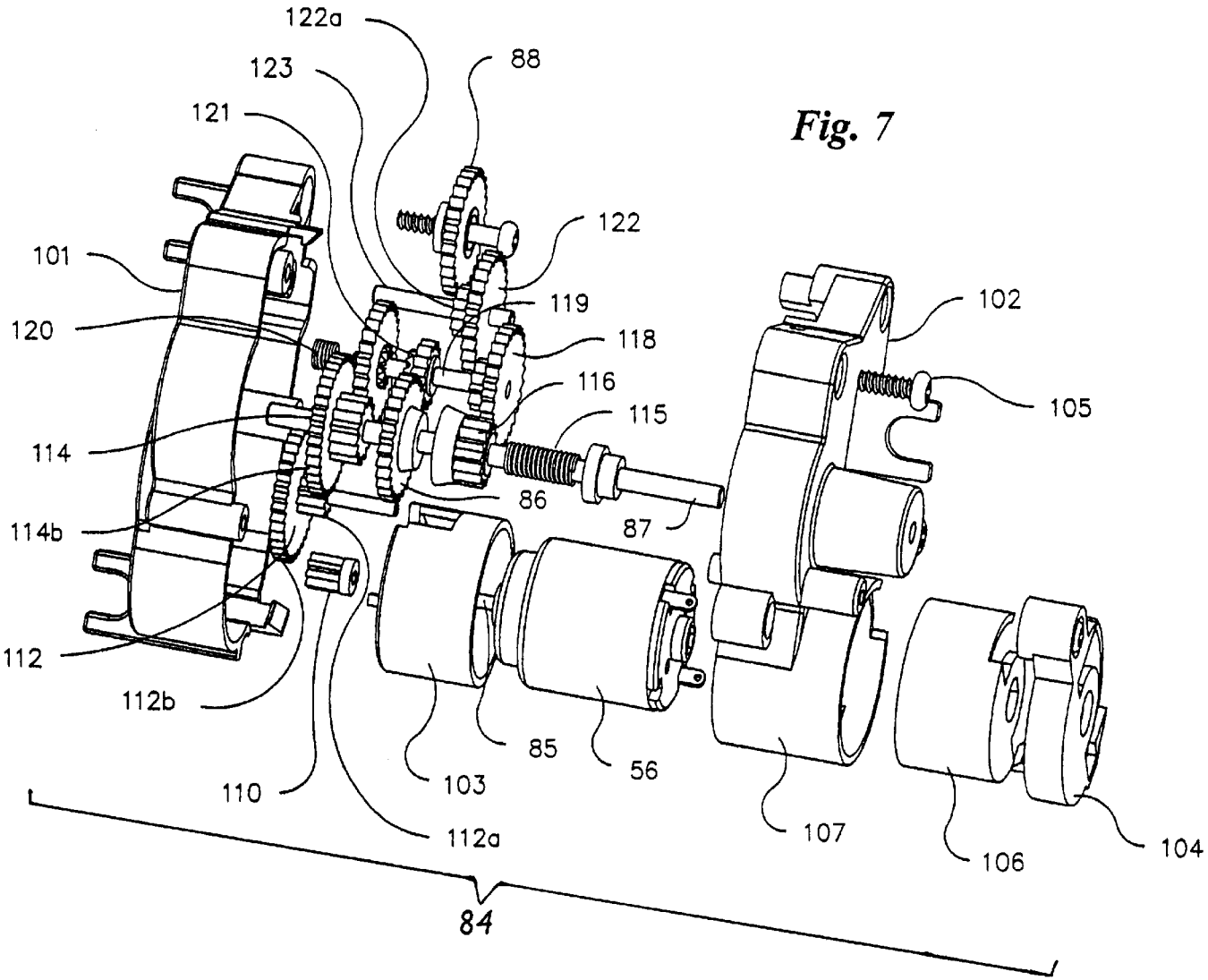
FIG. 7 is a perspective exploded view of a motor and transmission assembly in accordance with a preferred embodiment of the present invention.

The sound activated toy vehicle 50 includes a body 52, a chassis 54 and a motor 56 (FIG. 7). The chassis 54 accommodates the body 52 and has at least a front wheel 58 and a rear wheel 60. Preferably, the chassis has two front wheels 58 and two rear wheels 60. The motor 56 is drivingly connected to at least one of the front wheels 58 and rear wheels 60. Preferably, the motor 56 is drivingly connected to the two rear wheels 60 as described in greater detail below.

The sound activated toy vehicle 50 also includes a sound transducer 62 supported in either the chassis 54 or the body 52 and configured to generate an electrical signal in response to detected sound such as a clicking noise, a specific frequency and the like. In the presently preferred embodiment, the sound transducer 62 is a condenser microphone. However, the sound transducer 62 may be other devices, such as Piezoelectric transducers, electromechanical reeds and the like, without departing from the broad scope of the present invention. The sound transducer 62 is mounted in the base of a sound collector configured to have the appearance of an antenna 64 with a slotted or screened sound transducer cover 64*a*. The collector/antenna 64 is formed of a resilient material such as a polymeric material capable of bending without breaking and capable of returning to its original orientation by its own resiliency. The collector/antenna 64 is mounted to a hood 65 of the toy vehicle 50 like a real antenna on a real vehicle. The collector 64 is larger in scale and proportion relative to the size of the toy vehicle 50 as compared to the proportional size of a real antenna on a real vehicle.

The sound activated toy vehicle 50 also includes a controller U1 (FIG. 8) having an input P2.0 electrically connected to the sound transducer 62 and an output or outputs P3.0, P3.1 electrically connected to the motor 56. The controller U1 changes at least one of the outputs P3.0, P3.1 to the motor 56 when an electrical signal is received by the input P2.0 from the sound transducer 62. A sound generator 66 is preferably electrically connected to another output V0 of the controller U1 for generating sounds. The sound generator 66 is preferably a conventional speaker 64. However, the sound generator 66 may be other known sound generating devices such a Piezoelectric ceramic disks, electromechanical reeds and the like, without departing from the broad scope of the present invention. Yet another output P3.2 of the controller U1 is connected to a light LTO for illuminating a light bar 68 mounted to the top of the vehicle 50.

The sound activated toy vehicle 50 further includes a vehicle accessory 70 supported on at least one of the chassis 54 and the body 52. The vehicle accessory 70 has an exterior portion 71 which is exposed (or exposable) on the vehicle 50 and an actuating mechanism 72 configured to move the accessory. The actuating mechanism 72 includes a carriage 74 movably secured to an internal surface of the body 52. The actuating mechanism 72 also includes a rack 76 having teeth 76*a* and a protrusion 76*b*. The rack 76 is mounted for movement, preferably sliding movement, between a first rack position and a second rack position in a volume defined by the carriage 74 and an internal surface of the body 52. The actuating mechanism 72 also includes a lever 78 having a first arm 80 rotatably coupled to the exterior portion 71 of the vehicle accessory 70. A torsion spring 82 is located between the first arm 80 and the interior surface of the body 52. The lever 78 is in contact with the protrusion 76b on the rack 76 such that tension of the spring 82 against the first arm 80 and the interior surface biases the rack 76 to the first rack position. The exterior portion 71 is moved from a first accessory position to a second accessory position by the rack 76 being moved from the first rack position to the second rack position. The vehicle accessory 70 is preferably one of a foldable extension ladder, a water cannon, a speed indicator/sign, a tow boom, a boom light, a trunk lid, a door, an equipment access panel, and an opening to an interior space. However, the vehicle accessory 70 may be other movable pieces without departing from the present invention. As shown in FIGS. 1–2, the vehicle accessory 70 is a moveable and foldable hose-boom.

The vehicle 50 further comprises a gearbox or transmission 84 having a drive gear 86 (FIG. 7) and a power take-off gear 88 each drivingly coupled to the motor 56. The power take-off gear 88 is operably coupled with the rack 76 so that when the motor shaft 85 turns in a first rotational direction, the rack 76 moves generally linearly from the first rack position to the second rack position. When the motor shaft 85 turns in a second rotational direction opposite the first rotational direction, the rack 76 moves generally linearly from the second rack position to the first rack position.

Referring to FIG. 7 in detail, there is shown motor 56 and gearbox 84 in accordance with a preferred embodiment of the present invention. The gear box 84 includes a first gear box cover 101 and a second gear box cover 102 which, together, encase the motor 56, the drive gear 86 and at least a portion of the power take-off gear 88. The first and second gear box covers 101, 102 are sandwiched together and secured by screws 105. A first motor cap 103 retains an end of the motor 56 proximate to the motor shaft 85 thereby providing support for the motor 56 within the gear box 84. A second motor cap 104 secures a motor retaining cover 106 and motor retaining sleeve 107 containing the rest of the motor 56 not supported by the first motor cap 103. A motor shaft gear 110 is fixedly attached to the motor shaft 85. The teeth of the motor shaft gear 110 are in mesh with a high speed side 112*b* of a primary speed reducing gear 112, teeth of a low speed side 112*a* of the primary speed reducing gear 112 are in mesh with teeth of a low speed side 114*b* of a first pressure clutch 114. The first pressure clutch 114 includes a first clutch spring 115. The first pressure clutch is mounted on the drive shaft 87 along with the drive gear 86. The drive gear 86 is fixed to the driveshaft 87 such that when the drive gear 86 turns the drive shaft 87 turns correspondingly. A first clutch pad 116 also mounted on the drive shaft 87 is biased by the first clutch spring 115 to cause the drive gear 86 to frictionally engage the first pressure clutch 114 causing teeth of the main drive gear 86 to engage teeth of a second pressure clutch 118. The second pressure clutch 118 includes a second pressure clutch pin 119, a second clutch spring 120 and a second clutch pad 121. The second pressure clutch 118, the second clutch spring 120 and the second clutch pad 121 are all mounted on the second pressure clutch pin 119. The second clutch spring 120 biases the second clutch pad 121 into engagement with the second pressure clutch 118. The second clutch pad 121 also includes teeth and the teeth of the second clutch pad 121 are in mesh with a high-speed side 122*a* of a secondary speed reducing gear 122. The secondary speed reducing gear 122 is mounted on a secondary speed-reducer shaft 123 and is allowed to spin freely on the secondary speed-reducer shaft 123. Teeth of the high-speed side 122*a* of the secondary speed reducing gear 122 are in mesh with the teeth of the power take-off gear 88.

Preferably the first and second gear box covers 101, 102 are formed of a polymeric material that is injection molded with preformed threaded holes, retainers, detents, shaft holders and the like. However, the first and second gearbox covers 101, 102 may be formed of other materials and by other methods. Preferably, the first and second pressure clutch assemblies 114–116, 118–121, the drive gear 86, the motor shaft gear 110, the primary speed reducing gear 112, the secondary speed reducing gear 122 and the power take-off gear 88 are all formed from a polymeric material that is substantially rigid, but lightweight. However, the first and second pressure clutch assemblies 114–116, 118–121, the drive gear 86, the motor shaft gear 110, the primary speed reducing gear 112, the secondary speed reducing gear 122 and the power take-off gear 88 may be formed of other materials without departing from the broad scope of the present invention. Further, while a number of gears and clutches are shown in a particular configuration of the present invention, it should be noted that other combinations of clutches and gears may be utilized without departing from the broad inventive scope herein.

Preferably the motor 56 is a DC motor of the known variety capable of operating in first and second opposing rotational directions based upon the polarity of voltage supplied to motor leads 56*a* and 56*b*. In operation, when the motor 56 turns in a first direction the motor shaft gear 110 turns the primary speed reducing gear 112 in a first direction which in turn turns the first pressure clutch 114 in the first direction. As long as the torque or back pressure on the drive shaft 87 remains within the tolerance of the first pressure clutch 114, the first pressure clutch 114 is able to turn the drive gear 86 in the first direction. The drive shaft 87 in turn is able to turn the rear wheels 60 in the first direction thereby moving the entire sound activated toy vehicle 50. However, should the sound activated toy vehicle 50 encounter an obstacle or some rough surface, torque on the wheels 60 may increase beyond the holding capability of the first pressure clutch 114 and the first clutch spring 115 may allow the first clutch pad 116 to disengage so that the motor 56, the motor shaft gear 110 and the primary speed reducing gear 112 all still turn in the first direction but do not effect movement on the drive shaft 87 through the first pressure clutch 114 due to slippage. In normal operation the first clutch pad 116 imparts movement on the second pressure clutch 118 thereby turning the second pressure clutch 118 in the first direction which in turn turns the second clutch pad 121 in the first direction. The second clutch pad 121 imparts motion on the secondary speed reducing gear 122 which in turn turns the power take-off gear 88 in the first direction. If the power take-off gear 88 encounters a torque or resistance beyond the rating for the second clutch pad 121 and second pressure clutch spring 120, the second clutch pad 121 is allowed to slip from the second pressure clutch 118 allowing movement of the second pressure clutch 118 but not imparting movement on the secondary speed reducing gear 122 and the power take-off gear 88.

Similarly, when the motor 56 turns in a second direction the motor shaft gear 110 turns the primary speed reducing gear 112 in a second direction which in turn turns the first pressure clutch 114 in the second direction. As long as the torque or back pressure on the drive shaft 87 remains within the tolerance of the first pressure clutch 114, the first pressure clutch 114 is able to turn the drive gear 86 in the second direction. The drive shaft 87 in turn is able to turn the rear wheels 60 in the second direction thereby moving the entire sound activated toy vehicle 50. However, should the sound activated toy vehicle 50 encounter an obstacle or some rough surface, torque on the wheels 60 may increase beyond the holding capability of the first pressure clutch 114 and the first clutch spring 115 may allow the first clutch pad 116 to disengage so that the motor 56, the motor shaft gear 110 and the primary speed reducing gear 112 all still turn in the second direction but do not effect movement on the drive shaft 87 through the first pressure clutch 114 due to slippage. In normal operation the first clutch pad 116 imparts movement on the second pressure clutch 118 thereby turning the second pressure clutch 118 in the second direction which in turn turns the second clutch pad 121 in the second direction. The second clutch pad 121 imparts motion on the secondary speed reducing gear 122 which in turn turns the power take-off gear 88 in the second direction. If the power take-off gear 88 encounters a torque or resistance beyond the rating for the second clutch pad 121 and second pressure clutch spring 120, the second clutch pad 121 is allowed to slip from the second pressure clutch 118 allowing movement of the second pressure clutch 118 but not imparting movement on the secondary speed reducing gear 122 and the power take-off gear 88.

Referring again to FIG. 2, the sound activated toy vehicle 50 is preferably used in combination with a remote sound generating device 90. The remote sound generating device or remote device 90 includes a housing 92 formed by mating half shells 92*a*, 92*b*, one shell 92*b* having perforations 93 so as to permit sound waves to pass therethrough. The remote device 90 also includes a mechanical diaphragm 94 within the housing 92. The diaphragm 94 has a generally central portion 94*a*, an outer edge 94*b*, and a deflecting surface 94*c* connected to a portion 94*d* of the outer edge 94*b*. The outer edge 94*b* of the diaphragm 94 is at least partially secured so as to allow movement of the generally central portion 94*a* of the diaphragm 94. The remote device 90 further includes a pushbutton 96 protruding through an opening 95 in shell 92*a* of the housing 92. The pushbutton 96 directly contacts the deflecting surface 94*c* of the diaphragm 94 and is supported such that when the pushbutton 96 is pressed inwardly into the housing 92 by a user,(not shown), the pushbutton 96 moves the deflecting surface 94*c* thereby causing the generally central portion of the diaphragm 94 to move and generate a first sound. Preferably, the pushbutton 96 is coupled to a curved lever 91 to provide additional leverage for deflecting the diaphragm 94. Preferably, the housing 92 has the overall appearance of a badge such as a policeman's badge, a fireman's badge, a paramedic's badge, a security officer's badge, or the like. In the presently preferred embodiment the housing 92 has the overall appearance of a fireman's badge. Of course the sound generating device 90 is not critical to the present invention and could be any sound generating device capable of emitting a clicking or popping sound or some other repeatable sound that is recognizable to a control circuit 66 coupled to the sound transducer 62.

Figure 8:
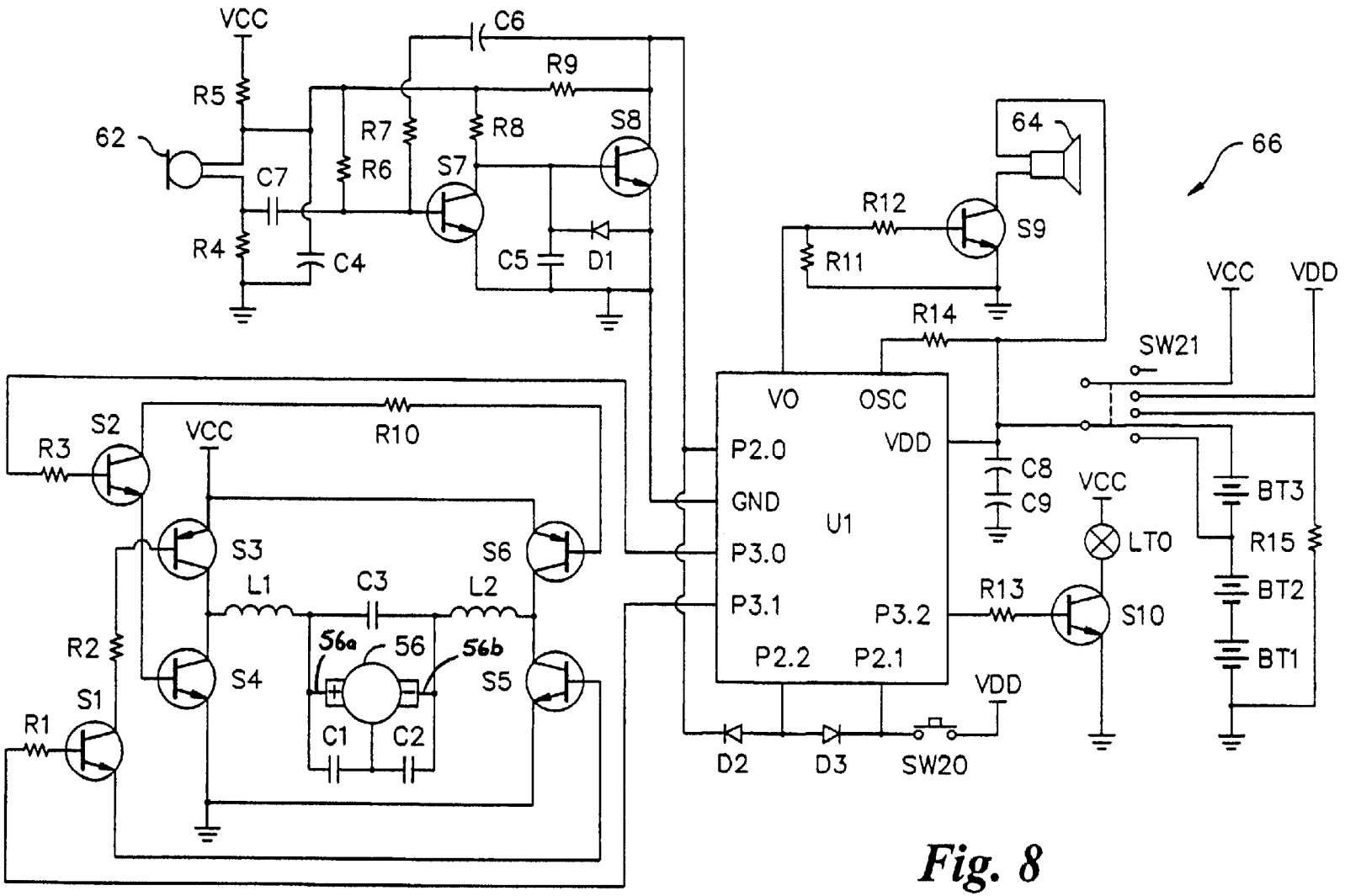
FIG. 8 is an electrical schematic diagram of a control circuit in accordance with a preferred embodiment of the present invention.

FIG. 8 is a schematic circuit diagram of a preferred embodiment of the control circuit 66 for use with or within the present invention. The control circuit 66 comprises the controller U1, a spring biased switch SW20, a three-position switch SW21, batteries BT1, BT2, BT3, capacitors C1–C9, resistors R1–R15, SCRs and/or transistors S1–S10, inductors L1–L2, diodes D1–D3, sound transducer 62, sound generating device 64, light LTO and motor 56. The controller U1 may be an application specific integrated circuit (ASIC), a microcontroller, a programmable array logic (PAL), a processor and the like without diverging from the present invention. The controller U1 includes inputs P2.0, P2.1 and P2.2 and outputs P3.0, P3.1, P3.2, and V0. When the controller U1 receives an input signal from switch SW20, output V0 energizes the sound generating device 64 and output P3.2 energizes the light LTO through transistors S9 and S10, respectively. Output V0 is capable of generating a variable output signal which creates a corresponding sound such as a siren or horn. When the controller U1 receives an input signal from the sound transducer 62, the controller U1 drives either output P3.0 or P3.1 in order to turn the motor 56 in a first direction of rotation for a predetermined amount of time or until the controller U1 receives a second input from sound transducer 62. When the controller U1 receives a second input signal from the sound transducer 62, the controller U1 drives the other of the outputs P3.0 or P3.1 in order to drive the motor 56 in a second direction of rotation, opposite the first direction of rotation, for a predetermined amount of time or until the controller U1 receives a third input signal from the sound transducer 62.

When three-position switch 21 is in a first position, only batteries BT1 and BT2 are connected in series thereby providing a first voltage to the controller U1 at voltage supply pin VDD. When three-position switch 21 is in a second position, none of the batteries are connected to the circuit and no voltage is provided to the controller U1 at voltage pin VDD. When three-position switch SW21 is in a third position, all three batteries BT1, BT2, BT3 are in series thereby providing a second voltage to the controller U1 at voltage pin VDD. When the controller U1 receives the first voltage at voltage pin VDD, the controller U1 does not operate the outputs P3.0, P3.1 that control the motor 56 regardless of the state of the other inputs P2.0, P2.1. When the controller U 1 receives the second voltage at voltage pin VDD, the controller U1 is able to operate the outputs P3.0, P3.1 to thereby control the motor 56 in either the first or the second direction of rotation.

While the control circuit 66 is shown with the electrical components described herein, other combinations of control devices and other control circuits may be utilized without departing from the present invention.

Figure 3:
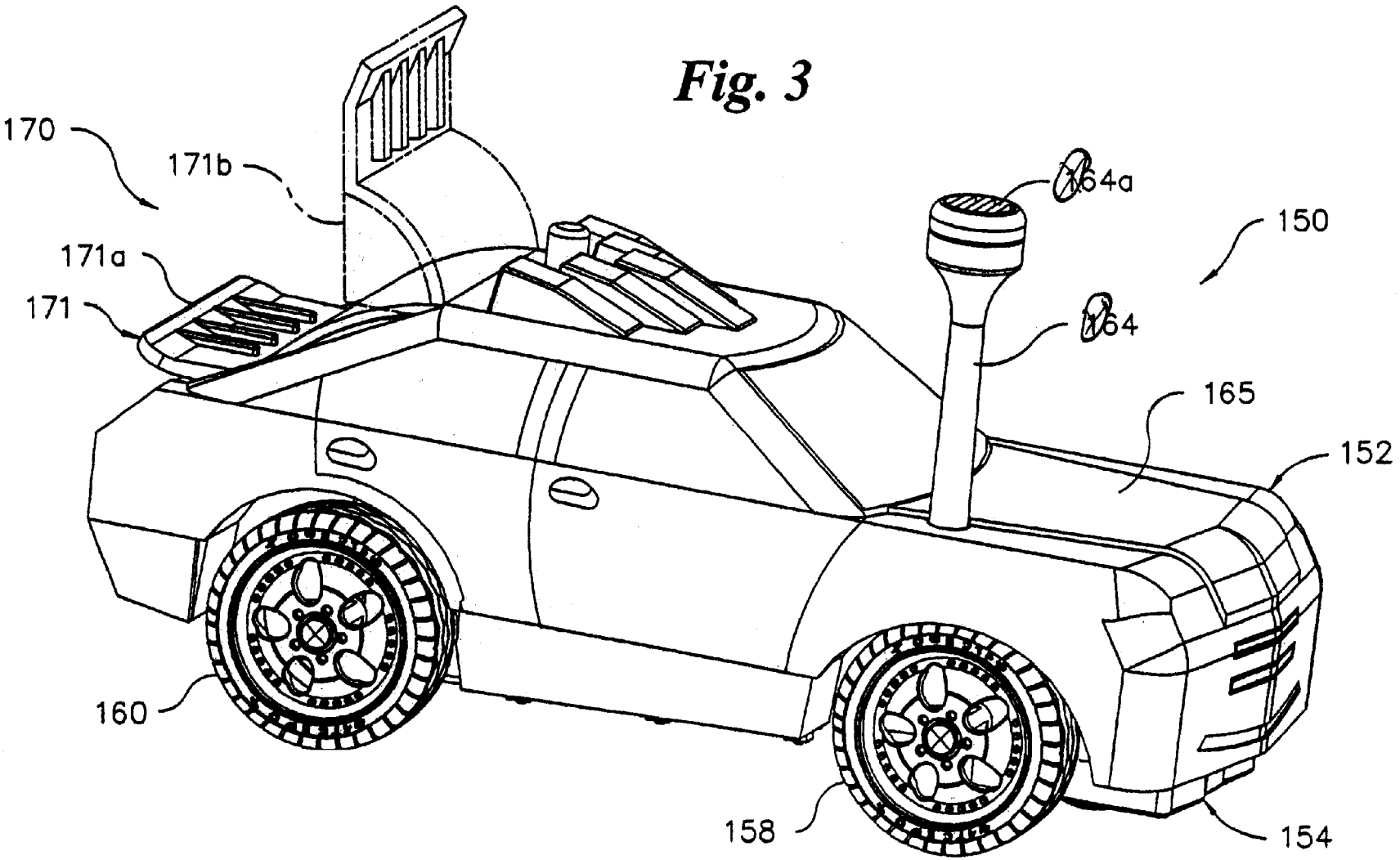
FIG. 3 is a perspective view of a sound activated toy vehicle in accordance with a second preferred embodiment of the present invention.
Figure 4:
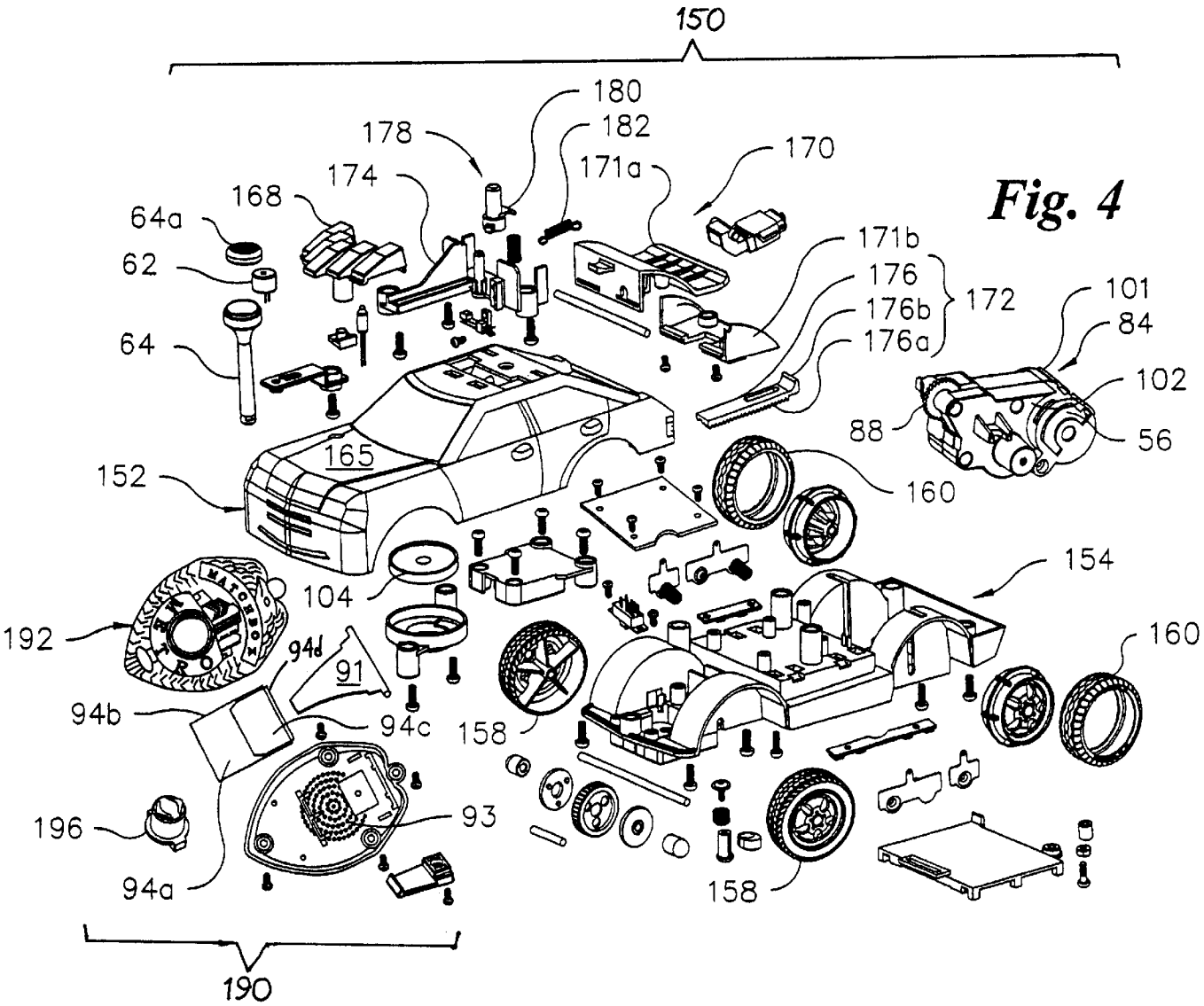
FIG. 4 is an exploded view of the vehicle of FIG. 3 in combination with a remote sound generating device.

FIGS. 3–4 show a sound activated toy vehicle 150 in accordance with a second preferred embodiment of the present invention. The sound activated toy vehicle 150 has the overall appearance of a police car. The sound activated toy vehicle 150 includes a body 152, a chassis 154 and a motor 56 (FIG. 7). The motor 56 and gear box 84 are identical to those described above regarding the first preferred embodiment. The chassis 154 accommodates the body 152 and, preferably, has two front wheels 158 and two rear wheels 160. The motor 56 maybe drivingly connected to at least one of the front wheels 158 and rear wheels 160, but is preferably drivingly connected to the two rear wheels 160 in the same way as the first vehicle 50.

The sound activated toy vehicle 150 also includes sound transducer 62 supported in either the chassis 154 or the body 152 and configured to generate an electrical signal in response to detected sound such as a clicking noise, a specific frequency, and the like. As in the first embodiment, sound transducer 62 is a condenser microphone. However, the sound transducer 62 may be other devices such as Piezoelectric transducers, electromechanical reeds and the like without departing from the broad scope of the present invention. The sound transducer 62 is again mounted in sound collector with antenna 64 having slotted or screened sound transducer cover 64*a*. The collector/antenna 64 is again mounted to a hood 165 of the toy vehicle 150 like a real antenna on a real vehicle.

Transducer 62 is again coupled to control circuit 66 having the controller U1 described above (FIG. 8) identical to that described for the first preferred embodiment.

The sound activated toy vehicle 150 further includes a vehicle accessory 170 supported on at least one of the chassis 154 and the body 152. The vehicle accessory 170 is preferably a moveable speed indicator 171*b* mounted under a moveable trunk lid 171*a* of the sound activated toy vehicle 150. However, the vehicle accessory 170 may be other movable pieces without departing from the present invention. The vehicle accessory 170 has an exterior portion 171 visible on the vehicle and an actuating mechanism 172. The actuating mechanism 172 includes a carriage 174 movably secured to an internal surface of the body 152. The actuating mechanism 172 also includes a rack 176 having teeth 176*a* and a protrusion 176*b*. The actuating mechanism 172 is moveable between a first rack position and a second rack position. The rack 176 is located in a volume defined by the carriage 174 and the internal surface of the body 152. The rack 176 is in sliding relationship within the volume defined by the carriage 174 and the internal surface of the body 152. The actuating mechanism 172 also includes a lever 178 having a first arm 180 rotatably coupled to the exterior portion 171 of the vehicle accessory 170. A spring 182 is located between the first arm 180 and the interior surface of the body 152. The lever 178 is in contact with the protrusion 176*b* on the rack 176 such that tension of the spring 182 against the first arm 180 and the interior surface biases the rack 176 to the first rack position. The exterior portion 171 is moved from a first accessory position to a second accessory position by the rack 176 being moved from the first rack position to the second rack position.

The chassis 154 further comprises a gearbox 84 having a drive gear 86 (FIG. 7) and a power take-off gear 88 each drivingly coupled to a shaft 85 of the motor 56 identically to the gearbox 84 described above regarding the first preferred embodiment. The power take-off gear 88 is operably coupled with the rack 176 so that when the motor shaft 85 turns in a first rotational direction, the rack 176 moves generally linearly from the first rack position to the second rack position. When the motor shaft 85 turns in a second rotational direction opposite the first rotational direction, the rack 176 moves generally linearly from the second rack position to the first rack position.

The sound activated toy vehicle 150 is preferably used in combination with a remote sound generating device 190. The remote sound generating device or remote device 190 is identical to device 90 but for a slightly different configuration of housing 192. Preferably, the housing 192 has the overall appearance of a policeman's badge.

Figure 5:
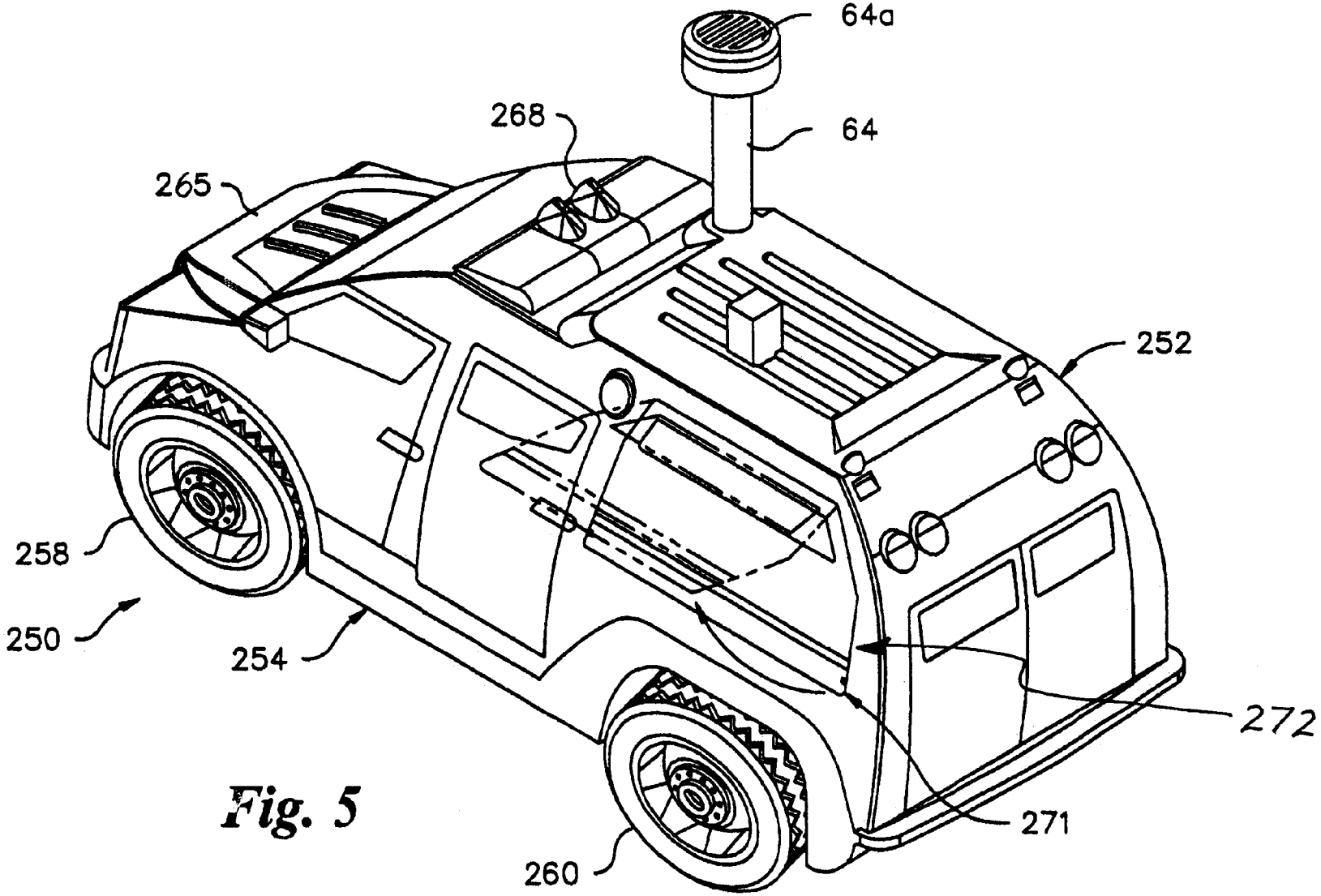
FIG. 5 is a perspective view of a sound activated toy vehicle in accordance with a third preferred embodiment of the present invention.
Figure 6:
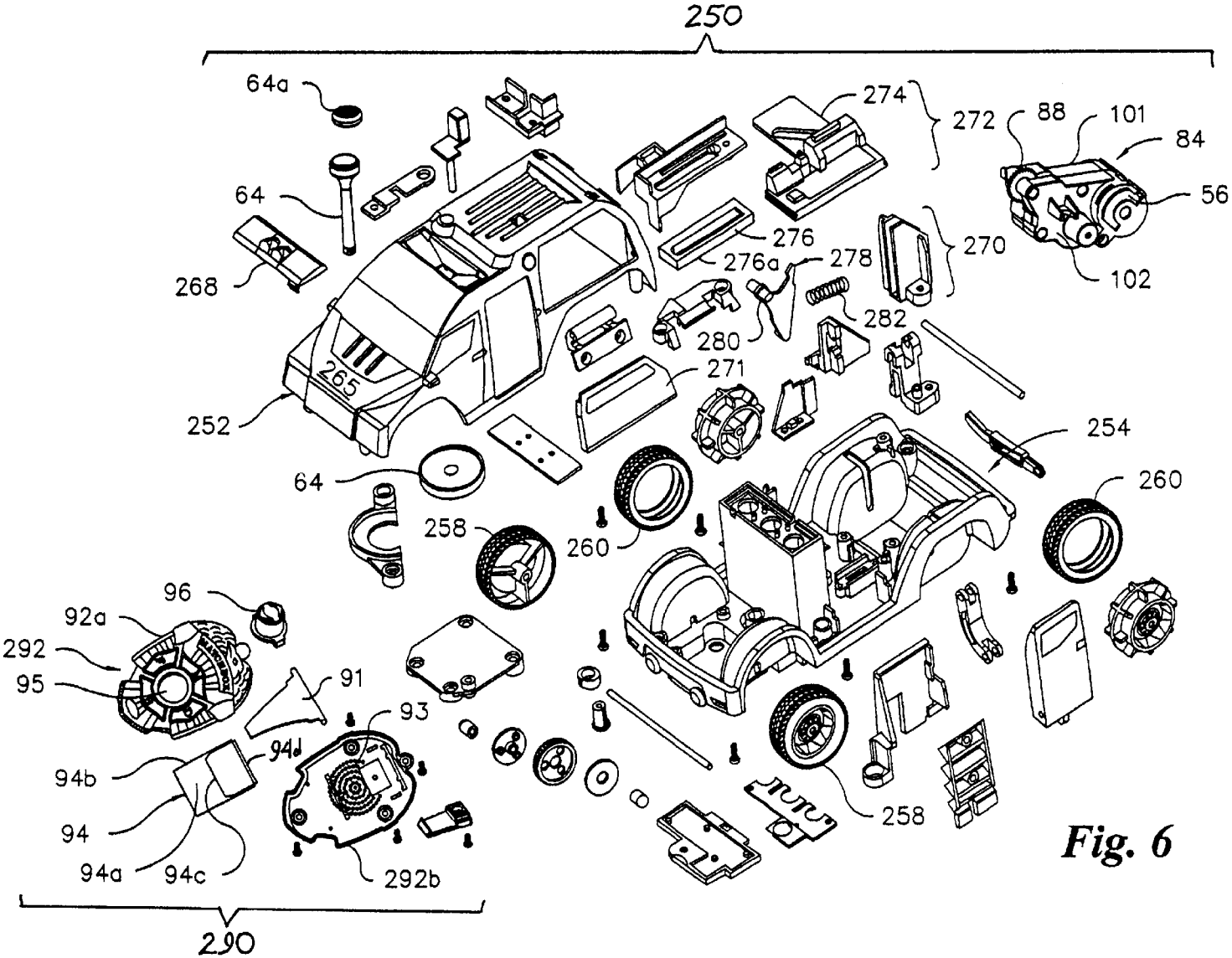
FIG. 6 is an exploded view of the vehicle of FIG. 5 in combination with a remote sound generating device.

FIGS. 5–6 show a sound activated toy vehicle 250 in accordance with a third preferred embodiment of the present invention. The sound activated toy vehicle 250 has the overall appearance of an ambulance. The sound activated toy vehicle 250 includes a body 252, a chassis 254 and a motor 56 (FIG. 7). The motor 56 and gear box 84 are identical to those described above regarding the first preferred embodiment. The chassis 254 accommodates the body 252 and has a front wheel 258 and a rear wheel 260. Preferably, the chassis has two front wheels 258 and two rear wheels 260. The motor is drivingly connected to at least one of the front wheels 258 and rear wheels 260, but the motor 56 is preferably drivingly connected to the rear wheels 260 as described in greater detail below.

The sound activated toy vehicle 250 also includes a sound transducer 62 supported in either the chassis 254 or the body 252 and configured to generate an electrical signal in response to detected sound such as a clicking noise, a specific frequency, and the like. In the presently preferred embodiment, the sound transducer 62 is a condenser microphone. However, the sound transducer 62 may be other devices such as Piezoelectric transducers, electromechanical reeds and the like without departing from the broad scope of the present invention. The sound transducer 62 is mounted in an antenna 64 having a microphone or sound transducer cover 64*a*. The antenna 64 is formed of a resilient material such as a polymeric material capable of bending without breaking and capable of returning to its original orientation by its own resiliency. The antenna 64 is mounted to a hood 265 of the toy vehicle 250 like a real antenna on a real vehicle. The antenna 64 is larger in scale and proportion relative to the size of the toy vehicle 250 as compared to the proportional size of a real antenna on a real vehicle.

The sound activated toy vehicle 250 also includes the control circuit 66 having the controller U1 described above (FIG. 8) identical to that described for the first preferred embodiment. The sound activated toy vehicle 250 further includes a vehicle accessory 270 supported on at least one of the chassis 254 and the body 252. The vehicle accessory 270 has an exterior portion 271 and an actuating mechanism 272. The actuating mechanism 272 includes a carriage 274 movably secured to an internal surface (not shown clearly) of the body 252. The actuating mechanism 272 also includes a rack 276 having teeth 276*a* and a protrusion 276*b*. The actuating mechanism 272 is moveable between a first rack position and a second rack position. The rack 276 is located in a volume defined by the carriage 274 and the internal surface 252*b* of the body 252. The rack 276 is in sliding relationship within the volume defined by the carriage 274 and the internal surface of the body 252. The actuating mechanism 272 also includes a lever 278 having a first arm 280 rotatably coupled to the exterior portion 271 of the vehicle accessory 270. A spring 282 is located between the first arm 280 and the interior surface of the body 252. The lever 278 is in contact with the protrusion 276*b* on the rack 276 such that tension of the spring 282 against the first arm 280 and the interior surface biases the rack 276 to the first rack position. The exterior portion 271 is moved from a first accessory position to a second accessory position by the rack 276 being moved from the first rack position to the second rack position. The vehicle accessory 270 is preferably a rotatable or moveable window 271*a* movably mounted in the side of the sound activated toy vehicle 250. However, the vehicle accessory 270 may be other movable pieces without departing from the present invention.

The chassis 254 further comprises a gearbox 84 having a drive gear 86 (FIG. 7) and a power take-off gear 88 each drivingly coupled to a shaft 85 of the motor 56 identically to the gearbox 84 described above regarding the first preferred embodiment. The power take-off gear 88 is operably coupled with the rack 276 so that when the motor shaft 85 turns in a first rotational direction, the rack 276 moves generally linearly from the first rack position to the second rack position. When the motor shaft 85 of the motor turns in a second rotational direction opposite the first rotational direction, the rack 176 moves generally linearly from the second rack position to the first rack position.

The sound activated toy vehicle 250 is preferably used in combination with a remote sound generating device 290. The remote sound generating device 290 is identical to device 90 but for a slightly different configuration of housing 292. Preferably, the housing 292 has the overall appearance of a paramedic's badge.

From the foregoing, it can be seen that the present invention comprises a sound activated toy vehicle including a vehicle accessory on either the chassis or the body wherein the vehicle accessory is moved by mechanical power from the motor. It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A sound activated toy vehicle, the toy vehicle comprising:

a body;

a chassis that accommodates the body and has at least a front wheel and a rear wheel;

a motor drivingly connected to at least one of the front wheel and the rear wheel;

a sound transducer supported in one of the chassis and body and configured to generate an electrical signal in response to detected sound;

a controller having an input electrically connected to the sound transducer and an output electrically connected to the motor, the controller changing the output to the motor when the electrical signal is received by the input from the sound transducer;

a vehicle accessory having an exterior portion and being supported for movement on at least one of the chassis and the body between a first position and a second position by mechanical power from the motor; and a sound generator electrically connected to another output of the controller.

2. The sound activated toy vehicle according to claim 1 further comprising a light electrically connected to another output of the controller.

3. The sound activated toy vehicle according to claim 1 wherein the vehicle accessory is one of a folding extension ladder, a water cannon, a speed indicator, a tow boom, a boom light, a trunk lid, a door, an equipment access panel and an opening to an interior space.

4. The sound activated toy vehicle according to claim 1 wherein the body is one of a police car, a fire rig, a fire truck, a tow truck, a sport utility vehicle, an ambulance, an off-road vehicle and a searchlight vehicle.

5. A sound activated toy vehicle the toy vehicle comprising:

a body;

a chassis that accommodates the body and has at least a front wheel and a rear wheel;

a motor configured drivingly connected to at least one of the front wheel and the rear wheel;

a sound transducer supported in one of the chassis and body and configured to generate an electrical signal in response to detected sound;

a controller having an input electrically connected to the sound transducer and an output electrically connected to the motor, the controller changing the output to the motor when the electrical signal is received by the input from the sound transducer;

a vehicle accessory having an exterior portion and being supported for movement on at least one of the chassis and the body between a first position and a second position by mechanical power from the motor;

wherein the vehicle accessory includes an actuating mechanism having:

a carriage movably secured to an internal surface of the body;

a rack having teeth and a protrusion, the rack being slideably supported in a volume defined by the carriage and an internal surface of the body; and a spring being in operative engagement with the protrusion on the rack so as to bias the rack to a first rack position;

wherein the exterior portion of the vehicle accessory is operatively coupled to the rack and being movable between a first accessory position and a second accessory position with movement of the rack from the first rack position to a second rack position.

6. The sound activated toy vehicle according to claim 5 wherein the exterior portion includes a first piece pivotally connected to the body.

7. The sound activated toy vehicle according to claim 6 wherein the exterior portion further includes a second piece pivotally connected to the first piece.

8. A sound activated toy vehicle, the toy vehicle comprising:

a body;

a chassis that accommodates the body and has at least a front wheel and a rear wheel;

a motor drivingly connected to at least one of the front wheel and the rear wheel;

a sound transducer supported in one of the chassis and body and configured to generate an electrical signal in response to detected sound;

a controller having an input electrically connected to the sound transducer and an output electrically connected to the motor, the controller changing the output to the motor when the electrical signal is received by the input from the sound transducer; and a vehicle accessory having an exterior portion and being supported for movement on at least one of the chassis and the body between a first position and a second position by mechanical power from the motor;

wherein the vehicle accessory includes an actuating mechanism having:

a carriage movably secured to an internal surface of the body;

a rack having teeth and a protrusion, the rack being slidably supported in a volume defined by the carriage and an internal surface of the body; and a spring being in operative engagement with the protrusion on the rack so as to bias the rack to a first rack position;

wherein the exterior portion of the vehicle accessory is operatively coupled to the rack and being movable between a first accessory position and a second accessory position with movement of the rack from the first rack position to a second rack position; and wherein the chassis further comprises a gear box having a drive gear and a power take-off gear each drivingly coupled to a shaft of the motor, the power take-off gear being operably coupled with the rack so that when the motor shaft turns in a first direction the rack moves from the first rack position to the second rack position.

9. The sound activated toy vehicle according to claim 8 wherein when the motor shaft turns in a second direction opposite the first direction, the rack moves from the second rack position to the first rack position.

10. A sound activated toy vehicle in combination with a remote sound generating device, the toy vehicle comprising:

a body;

a chassis that accommodates the body and has at least a front wheel and a rear wheel;

a motor configured drivingly connected to at least one of the front wheel and the rear wheel;

a sound transducer supported in one of the chassis and body and configured to generate an electrical signal in response to detected sound;

a controller having an input electrically connected to the sound transducer and an output electrically connected to the motor, the controller changing the output to the motor when the electrical signal is received by the input from the sound transducer;

a vehicle accessory having an exterior portion and being supported for movement on at least one of the chassis and the body between a first position and a second position by mechanical power from the motor; and the remote device including:

a housing having perforations so as to permit sound waves to pass;

a mechanical diaphragm within the housing having a generally central portion, an outer edge and a deflecting surface connected to a portion of the outer edge, the outer edge of the diaphragm being at least partially secured so as to allow movement of the generally central portion; and a pushbutton protruding through the housing, the pushbutton being operatively coupled with the deflecting surface of the diaphragm and supported such that when the pushbutton is pressed inwardly into the housing by a user, the pushbutton moves the deflecting surface thereby causing the generally central portion of the diaphragm to move and generate a first sound.

11. The sound activated toy vehicle according to claim 10 wherein the housing has the form of a badge.

* * * * *